US006127047A

United States Patent [19]

Worrell et al.

[11] Patent Number: 6,127,047

[45] Date of Patent: Oct. 3, 2000

[54] HIGH TEMPERATURE ALLOYS

[75] Inventors: Wayne L. Worrell, Penn Valley; Kang N. Lee, Philadelphia, both of Pa.

[73] Assignee: The Trustees of the University of Pennsylvania, Philadelphia, Pa.

[21] Appl. No.: 07/837,619

[22] Filed: Feb. 18, 1992

Related U.S. Application Data

[63] Continuation of application No. 07/641,314, Jan. 14, 1991, abandoned, which is a continuation of application No. 07/247,413, Sep. 21, 1988, abandoned.

[51] Int. Cl.[7] ..... B32B 15/00

[52] U.S. Cl. ..... 428/615; 428/652; 428/670; 428/678; 428/663; 428/215; 428/408; 428/580; 420/433; 420/443; 420/444; 420/445; 420/461; 420/548; 420/549; 420/578; 148/415; 148/437

[58] Field of Search ..... 428/408, 615, 428/652, 670, 678, 663, 215; 420/433, 443, 444, 445, 461, 548, 549, 578, 580; 48/415, 437

[56] References Cited

U.S. PATENT DOCUMENTS

| | | | |
|---|---|---|---|
| 3,325,279 | 6/1967 | Lawrence et al. | 419/29 |
| 3,471,286 | 10/1969 | Strong et al. | 420/549 |
| 3,480,429 | 11/1969 | Thiede et al. | 420/580 |
| 3,554,737 | 1/1971 | Foster et al. | 420/433 |
| 4,036,601 | 7/1977 | Weimar et al. | 428/663 |
| 4,108,645 | 8/1978 | Mitchell et al. | 420/416 |
| 4,261,742 | 4/1981 | Coupland | 420/443 |
| 4,264,358 | 4/1981 | Johnson et al. | 148/405 |
| 4,374,183 | 2/1983 | Deadmore et al. | 428/641 |
| 4,383,970 | 5/1983 | Komuro et al. | 420/528 |
| 4,447,503 | 5/1984 | Dardi et al. | 428/632 |
| 4,451,431 | 5/1984 | Naik | 420/588 |
| 4,476,164 | 10/1984 | Veltri et al. | 427/249.16 |
| 4,500,489 | 2/1985 | Nicoll | 420/445 |
| 4,543,235 | 9/1985 | Lemkey et al. | 420/443 |
| 4,585,481 | 4/1986 | Gupta et al. | 106/14.05 |
| 4,671,931 | 6/1987 | Herchenroeder et al. | 420/445 |
| 4,743,514 | 5/1988 | Strangman et al. | 428/678 |
| 4,746,584 | 5/1988 | Tenhover et al. | 428/670 |
| 4,764,225 | 8/1988 | Shankar | 148/404 |
| 4,767,678 | 8/1988 | Yates et al. | 428/632 |
| 4,828,632 | 5/1989 | Adam et al. | 148/437 |
| 4,859,416 | 8/1989 | Adelman | 420/443 |
| 4,879,095 | 11/1989 | Adam et al. | 420/548 |
| 4,902,475 | 2/1990 | Apelain et al. | 420/548 |

FOREIGN PATENT DOCUMENTS

| | | | |
|---|---|---|---|
| 026640 | 2/1985 | Japan . | |
| 1151231 | 5/1969 | United Kingdom | 420/549 |

OTHER PUBLICATIONS

Massalski, T.B., et al., eds., Binary Alloy Phase Diagrams, vol. 1 and 2, pp. 793, 854 and 1747 (1986).

Levin, E.M. and McMurdie, H.F., Phase Diagram for Ceramists, 1975 Supplement, p. 134, figure 4375.

*Primary Examiner*—Leszek Kiliman

*Attorney, Agent, or Firm*—Woodcock Washburn Kurtz Mackiewicz & Norris LLP

[57] ABSTRACT

High temperature alloys resistant to degradation and oxidation are provided. In accordance with preferred embodiments, alloys comprising from about 0.1 to about 50 atomic percent silicon, from about 10 to about 80 atomic percent aluminum, and at least one metal selected from the group consisting of chromium, iridium, rhenium, palladium, platinum, rhodium, ruthenium, osmium, molybdenum, tungsten, niobium and tantalum are formed. Shaped bodies and structural members comprising such alloys are also described as are methods for their fabrication.

21 Claims, 1 Drawing Sheet

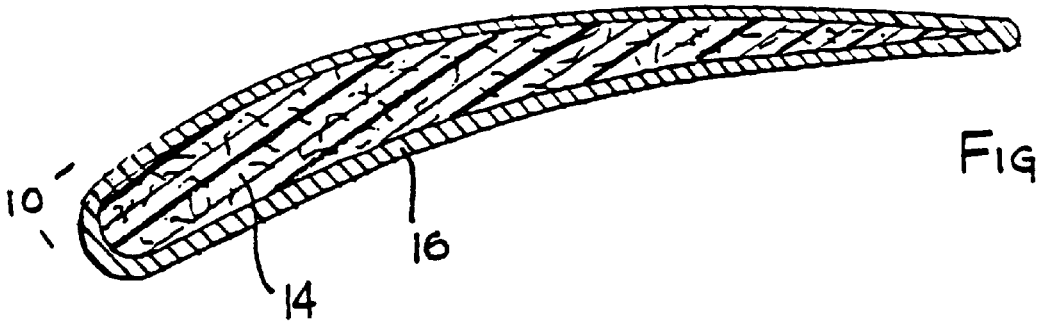
FIG 2
FIG 1
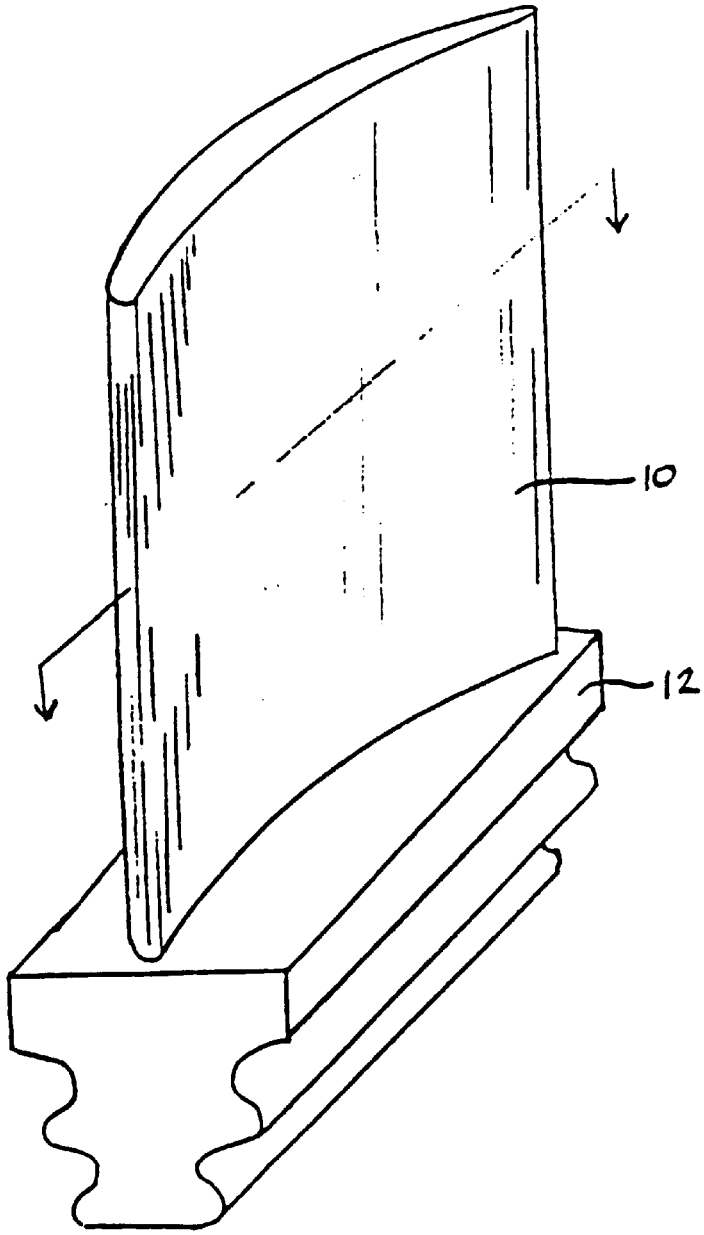

HIGH TEMPERATURE ALLOYS

This is a continuation of application Ser. No. 641,314, filed Jan. 14, 1991, now abandoned, which is a continuation of application Ser. No. 247,413, filed Sep. 21, 1988, now abandoned.

GOVERNMENT SUPPORT

Portions of this invention were supported by U.S. Air Force Grant F33615-86-C-5138.

BACKGROUND OF THE INVENTION

This invention relates to materials which melt only at very high temperatures and, more specifically, to alloys which melt only at high temperatures and exhibit improved resistance to oxidation at such temperatures.

There is presently great need for materials capable of sustained mechanical use at temperatures greater than about 1500° C. Such materials find use, for example, in the manufacture of turbine blades and other components of jet engines. Materials which can be employed in such uses must have very high melting points. Unfortunately, most high-melting materials rapidly oxidize in the environments to which they are often exposed. Carbon-carbon composite materials provide a good example of high melting materials which are rapidly oxidized at elevated temperatures. A major barrier to the utilization of carbon-carbon composites and similar materials in commercial high temperature applications has been the development of coatings or other treatments which can provide adequate protection from oxidation.

The tendency of these materials to oxidize at high temperatures has thus created great interest in protective coatings comprising a variety of metals, metalloids, and alloys, one such protective coating is silicon carbide, which is often used on structural elements composed of carbon-carbon composites. Silicon carbide is believed to protect such materials by forming a surface layer of protective silicon oxide scale. However, silicon carbide coatings fail to provide adequate oxidation protection at temperatures above about 1500° C.

An other class of coatings for carbon-carbon composites and other high-temperature materials comprises iridium and iridium-containing alloys. Alloys comprising iridium are among the most promising materials for applications in high temperature environments, due in considerable part to iridium's relatively high (2454° C.) melting point. However, elemental iridium is quite expensive compared with other materials employed in high temperature applications. In addition, iridium and many iridium-containing alloys can have associated with them a number of serious performance-related difficulties. For example, coatings comprising iridium may exhibit adhesion problems in high temperature environments with materials such as carbon-carbon composites. A more serious difficulty in using iridium-containing alloys is their degradative tendency to rapidly form gaseous iridium oxides, such as $IrO_2$ and $IrO_3$, at high temperatures.

It is known that the generation of gaseous iridium oxides can be minimized or eliminated by the formation of a protective metal oxide barrier on the surface of an iridium-containing galloy. For example, it is known that when aluminum is incorporated into such alloys, an $Al_2O_3$ barrier layer can be generated on the alloy's surface at high temperatures. This alumina scale inhibits the formation of iridium oxides. However, prior alloys consisting of iridium and aluminum are known to form truly protective external $Al_2O_3$ layers only when the concentration of aluminum in the alloy is greater than about 55 atomic percent (at %). The minimum concentration of aluminum which needs be present in a given alloy to produce an effectively protective oxide layer is known as the alloy's critical aluminum concentration. At aluminum concentrations lower than the critical aluminum concentration, iridium/aluminum alloys form cracked or porous $Al_2O_3$ layers which fail to inhibit both the transport of oxygen and the degradative generation of gaseous iridium oxides resulting therefrom.

Because aluminum has a relatively low melting point (660° C.), its incorporation into an alloy generally has a deleterious effect upon the alloy's melting point. For example, the critical aluminum concentration in an iridium-containing alloy significantly lowers the melting point of the alloy as compared with its non aluminum-containing counterpart. It is therefore greatly desired that the incorporation of aluminum into alloys intended for high temperature applications be reduced without reducing the resistance to degradation of these alloys.

It is therefore an object of this invention to provide alloys capable of advantageous, sustained use at high temperatures.

It is a further object of this invention to provide such high temperature alloys as inexpensively as practicable.

It is another object of this invention to provide high temperature alloy coatings with good adhesion to a wide variety of substrates.

It is a further object of this invention to provide such alloys with improved resistance to even harsh oxidizing environments. Further objects are to provide shaped bodies comprising such alloys for structural, mechanical and chemical use and to secure methods for their fabrication.

BRIEF DESCRIPTION OF THE DRAWINGS

FIG. 1 is an example of a shaped body, a turbine blade, comprising an alloy in accordance with the invention .

FIG. 2 is a cross section of one turbine blade in accordance with a preferred subembodiment of the invention.

SUMMARY OF THE INVENTION

It has now been discovered that materials capable of sustained use at elevated temperatures can be formulated from iridium, rhenium, and certain other metals having melting points greater than about 1500° C. A preferred means of preparing such alloys involves the inclusion of silicon in their aluminum alloys. Thus, alloys having at once, improved resistance to oxidative and other forms of degradation and high utility at elevated temperatures can now be prepared in accordance with the practice of the present invention. Such alloys are preferably formulated from aluminum, silicon, and at least one metal selected from the group consisting of chromium, iridium, rhenium, palladium, platinum, rhodium, ruthenium, osmium, molybdenum, tungsten, niobium and tantalum. The proportions of metal, aluminum and silicon are selected to result in alloys exhibiting a combination of diminished oxidative degradation and high temperature stability which is improved over alloys not comprising silicon.

While the foregoing group of metals is believed to be useful generally in the practice of one or more subemodiments of this invention, a preferred group consists of iridium, palladium, platinum, rhodium, ruthenium and osmium. Iridium and ruthenium are most preferred.

In accordance with preferred embodiments of this invention, high temperature alloys comprising up to about 65 atomic percent of at least one metal selected from the group consisting of chromium, iridium, rhenium, palladium, platinum, rhodium, ruthenium, osmium, molybdenum, tungsten, niobium and tantalum are produced preferably from molten mixtures of elemental components. Especially preferred metals are iridium and rhenium. The high temperature alloys of this invention also comprise from about 0.1 to about 50 atomic percent silicon and from about 10 to about 80 atomic percent aluminum. Preferred alloys comprise from about 3 to about 40 atomic percent silicon and from about 20 to about 60 atomic percent aluminum. Especially preferred alloys comprise from about 3 to about 40 atomic percent silicon and from about 30 to about 60 atomic percent aluminum. Preferred alloys comprise from about 3 to about 20 atomic percent silicon and from about 20 to about 60 atomic percent aluminum, more preferably from about 3 to about 10 atomic percent silicon and from about 30 to about 60 atomic percent aluminum.

In accordance with other embodiments, structural bodies capable of sustained use at elevated temperatures are provided; said bodies comprise the high temperature alloys of this invention either in whole or in part. It will be appreciated by those of skill in the art that the alloys of this invention can be employed either as protective coatings for a wide variety of materials or as the sole or main constituent of bodies designed for exposure to high temperatures or oxidizing environments, or both. As such, the molten or hardened forms of these materials may be cast, extruded, molded, shaped, applied, or otherwise elaborated into high temperature bodies. Such materials may also be prepared through powder metallurgy. A preferred means of such elaboration is the employment of high temperature alloys as protective coatings for composite materials. Composite materials are known per se to be combinations of two or more materials present as separate phases and combined so as to take advantage of certain desirable properties of each compound. The constituents can be organic, inorganic, or metallic in the form of particles, rods, fibers, plates, and foams. Carbon-carbon composites are exemplary of this class. FIG. 1 depicts one such shaped body, a turbine blade, 10 shown in a support, 12. FIG. 2 is an expanded cross section of blade, 10 not drawn to scale. In accordance with a preferred embodiment, blade 10 is comprised of structural core 14 and coating 16 which is provided in accordance with the invention.

Other shaped bodies such as sensors, catalyst bodies, vessels, and structural members may also be formed from alloys in accordance with the invention either in whole or in part and preferably as a coating.

The incorporation of rhenium into iridium-containing alloys by this invention has been found to improve the adhesion of such coatings to various structural underlayments. This is true for both silicon-containing and non-silicon-containing alloys. Because rhenium has a higher melting point than iridium and is generally less expensive, both economic and performance-property advantages have been realized where rhenium has been used either in place of or in conjunction with iridium. Unfortunately, like iridium, rhenium exhibits a tendency to readily oxidize at high temperatures. Such oxidation can be effectively inhibited by incorporating aluminum into alloys comprising these metals, albeit with concomitant melting point diminution. For example, ternary iridium/rhenium/aluminum high temperature alloys preferably comprise from about 10 to about 30 atomic percent iridium, from about 10 to about 30 atomic percent rhenium, and from about 60 to about 80 atomic percent aluminum.

However, the addition of silicon to these and other alloys of this invention has been found to markedly reduce the concentration of aluminum that needs to be present in such alloys for the generation of effectively protective $Al_2O_3$ surface barrier scale. For example, it has been found that the addition of silicon can reduce the critical aluminum concentration in an iridium-based alloy from more than about 55 atomic percent to about 20 atomic percent. In addition to significantly decreasing the critical aluminum concentration for such alloys in accordance with this invention, silicon is believed to enhance the protectiveness of oxide layers believed to be formed.

When the metal is selected from the group iridium, palladium, platinum, rhodium, ruthenium, and osmium then it is preferred that the alloy comprise from about 3 to about 10 atomic percent silicon and from about 30 to about 60 atomic percent aluminum, preferably from about 20 to about 40 atomic percent silicon and from about 20 to about 50 atomic percent aluminum.

When the metal selected is from the group chromium, rhenium, molybdenum, tungsten, niobium and tantalum then it is preferred that the alloy comprise from about 20 to about 40 atomic percent silicon and from about 20 to about 50 atomic percent aluminum. Even more preferred alloys of this group of metals are formed from about 30 to about 40 atomic percent silicon and from about 30 to about 40 atomic percent aluminum.

The invention is now described in connection with the following examples. The associated experimental data, relating to changes in the weights of a number of alloys exposed to high temperature, oxidizing environments, reveal the improved oxidation resistance of the aluminum and silicon-containing alloys of this invention.

EXAMPLE 1

Various alloys were prepared by arc melting predetermined weights of pure metals in an argon environment. For example, an alloy comprising 42 atomic percent iridium, 50 atomic percent aluminum, and 8 atomic percent silicon was prepared from 4.1845 grams iridium, 0.699 grams aluminum, and 0.1165 grams silicon. To prevent the preferential loss of the relatively low-melting aluminum and silicon, they were covered with solid iridium, rhenium, or both, as designated. High melting iridium, rhenium, or both were carefully arc melted; the molten melt dissolved the aluminum and silicon. To ensure the homogenization of the respective alloys, each side of the alloy coupon was arc melted four times.

After preparation of a respective alloy, a specimen having approximate dimensions of 1.0 centimeters by 0.5 centimeters by 0.2 centimeters was cut from the coupon with a diamond saw. Each specimen was exposed to 1.0 atmosphere oxygen at 1550° C. (or as noted) and observed weight changes over time were noted.

| Alloy Composition (at %) | Weight change (mg./cm.$^2$) | | | | | | |
|---|---|---|---|---|---|---|---|
| | 25 h | 50 h | 75 h | 95 h | 145 h | 200 h | 280 h |
| Ir—Al—Si | | | | | | | |
| 40-60-0 | 5.93 | 7.58 | 7.32 | −9.02 | — | — | — |
| 37-60-3 | 7.60 | — | — | — | 9.47 | — | — |
| 40-50-10 | 6.80 | — | — | — | 11.68 | — | — |
| 42-50-8 | 6.30 | — | — | — | 9.52 | — | — |
| 50-40-10 | 4.74 | 5.03 | 5.92 | 6.71 | — | — | — |
| 52-40-8 | 5.71 | — | — | — | 8.98 | — | — |
| 55-30-15 | 9.50 | — | — | — | 13.18 | — | — |
| 60-30-10 | 4.84 | 7.12 | 7.87 | 7.77 | 7.67 | 7.36 | 7.29 |
| 60-20-20 | 6.63 | 8.50 | — | — | — | — | — |
| 42-50-8 (1600° C.) | 7.84 | 10.16 | 12.27 | 13.11 | 15.75 | — | — |
| Re—Al—Si | | | | | | | |
| 30-40-30 | 5.70 | — | — | — | 4.87 | — | — |
| 40-30-30 | −10.00 | — | — | — | −11.00 | — | — |

-continued

| Alloy Composition (at %) | Weight change (mg./cm.$^2$) | | | | | | |
|---|---|---|---|---|---|---|---|
| Ir—Re—Al—Si | | | | | | | |
| 19-18-60-3 | 5.50 | — | — | — | — | — | — |
| 12-30-50-8 | 5.00 | — | — | — | 11.48 | — | — |
| | 5 h | 10 h | 15 h | 20 h | 24 h | | |
| Ir—Al—Re | | | | | | | |
| 40-60-0 | 3.16 | 4.30 | 4.89 | 5.26 | — | | |
| 30-60-10 | 3.23 | 4.45 | 4.80 | — | — | | |
| 20-60-20 | 3.34 | 4.32 | 4.97 | — | — | | |
| 10-60-30 | — | — | — | — | 5.23 | | |

EXAMPLE 2

The method of Example 1 was followed, except that molybdenum, tungsten and niobium were employed as high temperature components in place of iridium and rhenium. Also, the specimens were tested at 1550° C. in atmospherically pressurized air.

| Alloy Composition (at %) | Weight change (mg./cm.$^2$) 24 hours |
|---|---|
| Mo—Al—Si | |
| 30-30-40 | 5.63 |
| 30-40-30 | 5.70 |
| W—Al—Si | |
| 30-30-40 | 4.73 |
| 30-40-30 | 6.13 |
| Nb—Al—Si | |
| 30-30-40 | 9.67 |

EXAMPLE 3

The method of Example 1 was followed, except that the specimen was tested at 1800° C.

| Alloy Composition (at %) | Weight change (mg./cm.$^2$) 1 h | 5 h | 10 h | 15 h |
|---|---|---|---|---|
| Ir—Al—Si | | | | |
| 60-30-10 | 2.88 | 5.88 | 3.92 | 3.82 |

As can be seen in the foregoing examples, the alloys of this invention are structurally stable at high temperatures and exhibit remarkably good resistance to harshly oxidizing environments. For example, the alloy having 60 atomic percent iridium, 30 atomic percent aluminum, and 10 atomic percent silicon exhibited excellent oxidation resistance over five times longer than an alloy having 60 atomic percent iridium, 40 atomic percent aluminum, and no silicon. After 50 to 75 hours, the iridium/aluminum alloy with no silicon starts to lose weight due to the formation of gaseous iridium oxides; the silicon-containing alloy does not show a significant weight loss until after about 300 hours. It is believed that silicon enhances the protectiveness of the iridium/aluminum/silicon ternary alloys by forming a silica-rich oxide barrier layer at the bottom of any cracks which might develop in the outer alumina scale, thus inhibiting oxidation of underlying materials.

What is claimed is:

1. An alloy comprising:

rhenium;

from about 20 to about 40 atomic percent silicon; and from about 20 to about 50 atomic percent aluminum; said alloy being resistant to oxidation at 1550° C.

2. An alloy comprising:

from about 10 to about 30 atomic percent iridium;

from about 10 to about 30 atomic percent rhenium; and from about 60 to about 80 atomic percent aluminum; said alloy being resistant to oxidation at 1550° C.

3. A shaped body comprising an alloy that is resistant to oxidation at 1550° C. and that comprises:

from about 0.1 to about 50 atomic percent silicon;

from about 10 to about 80 atomic percent aluminum; and iridium in an amount up to about 65 atomic percent of said alloy; or from about 20 to about 40 atomic percent silicon;

from about 20 to about 50 atomic percent aluminum; and rhenium; or from about 10 to about 30 atomic percent iridium;

from about 10 to about 30 atomic percent rhenium; and from about 60 to about 80 atomic percent aluminum;

said iridium and rhenium being present in amounts totaling up to about 40 atomic percent of said alloy; or from about 0.1 to about 50 atomic percent silicon;

from about 10 to about 80 atomic percent aluminum; and iridium and rhenium in amounts totaling up to about 65 atomic percent of said alloy.

4. A shaped body comprising:

composite material; and an alloy upon said composite material; wherein said alloy is resistant to oxidation at 1550° C. and comprises:

from about 0.1 to about 50 atomic percent silicon;

from about 10 to about 80 atomic percent aluminum; and iridium in an amount up to about 65 atomic percent of said alloy; or from about 20 to about 40 atomic percent silicon;

from about 20 to about 50 atomic percent aluminum; and rhenium; or from about 10 to about 30 atomic percent iridium;

from about 10 to about 30 atomic percent rhenium; and from about 60 to about 80 atomic percent aluminum;

said iridium and rhenium being present in amounts totaling up to about 40 atomic percent of said alloy; or from about 0.1 to about 50 atomic percent silicon;

from about 10 to about 80 atomic percent aluminum; and iridium and rhenium in amounts totaling up to about 65 atomic percent of said alloy.

5. A method for fabricating a shaped body, comprising:

providing a structural core; and coating upon said core an alloy; wherein said alloy is resistant to oxidation at 1550° C. and comprises:

from about 0.1 to about 50 atomic percent silicon;

from about 10 to about 80 atomic percent aluminum; and iridium in an amount up to about 65 atomic percent of said alloy; or from about 20 to about 40 atomic percent silicon;

from about 20 to about 50 atomic percent aluminum; and rhenium; or from about 10 to about 30 atomic percent iridium;

from about 10 to about 30 atomic percent rhenium; and from about 60 to about 80 atomic percent aluminum;

said iridium and rhenium being present in amounts totaling up to about 40 atomic percent of said alloy; or from about 0.1 to about 50 atomic percent silicon;

from about 10 to about 80 atomic percent aluminum; and iridium and rhenium in amounts totaling up to about 65 atomic percent of said alloy.

6. A method for fabricating a shaped body, comprising:

providing an alloy; and shaping said alloy; wherein said alloy is resistant to oxidation at 1550° C. and comprises:

from about 0.1 to about 50 atomic percent silicon;

from about 10 to about 80 atomic percent aluminum; and iridium in an amount up to about 65 atomic percent of said alloy; or from about 20 to about 40 atomic percent silicon;

from about 20 to about 50 atomic percent aluminum; and rhenium; or from about 10 to about 30 atomic percent iridium;

from about 10 to about 30 atomic percent rhenium; and from about 60 to about 80 atomic percent aluminum;

said iridium and rhenium being present in amounts totaling up to about 40 atomic percent of said alloy; or from about 0.1 to about 50 atomic percent silicon;

from about 10 to about 80 atomic percent aluminum; and iridium and rhenium in amounts totaling up to about 65 atomic percent of said alloy.

7. An alloy comprising:

from about 0.1 to about 50 atomic percent silicon;

from about 10 to about 80 atomic percent aluminum; and iridium in an amount up to about 65 atomic percent of said alloy, said alloy being resistant to oxidation at 1550° C.

8. An alloy comprising:

from about 0.1 to about 50 atomic percent silicon;

from about 10 to about 80 atomic percent aluminum; and iridium and rhenium in amounts totaling up to about 65 atomic percent of said alloy, said alloy being resistant to oxidation at 1550° C.

9. The alloy of claim 1 comprising from about 30 to about 40 atomic percent silicon and from about 30 to about 40 atomic percent aluminum.

10. The alloy of claim 8 wherein the alloy comprises:

from about 3 to about 20 atomic percent silicon; and from about 20 to about 60 atomic percent aluminum.

11. The alloy of claim 8 wherein the alloy comprises:

from about 3 to about 10 atomic percent silicon; and from about 30 to about 60 atomic percent aluminum.

12. The alloy of claim 7 comprising from about 3 to about 20 atomic percent of silicon and from about 20 to about 60 atomic percent aluminum.

13. The alloy of claim 5 comprising from about 3 to about 10 atomic percent silicon and from about 30 to about 60 atomic percent aluminum.

14. The alloy of claim 7 comprising from about 20 to about 40 atomic percent silicon and from about 20 to about 50 atomic percent aluminum.

15. The alloy of claim 1 comprising from about 20 to about 40 atomic percent silicon and from about 20 to about 50 atomic percent aluminum.

16. The alloy of claim 1 comprising from about 30 to about 40 atomic percent silicon and from about 30 to about 40 atomic percent aluminum.

17. The alloy of claim 8 comprising from about 3 to about 40 atomic percent silicon and from about 20 to about 60 atomic percent aluminum.

18. The alloy of claim 8 comprising from about 3 to about 40 atomic percent silicon and from about 30 to about 60 atomic percent aluminum.

19. The alloy of claim 7 comprising from about 3 to about 40 atomic percent silicon and from about 20 to about 60 atomic percent aluminum.

20. The alloy of claim 7 comprising from about 3 to about 40 atomic percent silicon and from about 30 to about 60 atomic percent aluminum.

21. The structural member of claim 5 wherein the composite material comprises carbon-carbon.

* * * * *